US006822400B1

(12) United States Patent
Ha et al.

(10) Patent No.: US 6,822,400 B1
(45) Date of Patent: Nov. 23, 2004

(54) PROCESSOR CONTROLLED STROBE

(75) Inventors: Simon Ha, Aurora, IL (US); Daniel C. Scheffler, Winfield, IL (US); Daniel J. Austin, Streamwood, IL (US)

(73) Assignee: Honeywell International, Inc., Morristown, NJ (US)

( * ) Notice: Subject to any disclaimer, the term of this patent is extended or adjusted under 35 U.S.C. 154(b) by 176 days.

(21) Appl. No.: 09/767,897

(22) Filed: Jan. 23, 2001

(51) Int. Cl.[7] ..... H05B 37/02
(52) U.S. Cl. ..... 315/241 S; 315/219; 396/164
(58) Field of Search ..... 315/200 A, 241 S, 315/241 P, 241 R, 200 R, 185 R, 291, 308, 219, 209 R; 396/164, 206

(56) References Cited

U.S. PATENT DOCUMENTS 5,341,069 A 8/1994 Kosich et al.
5,400,009 A * 3/1995 Kosich et al. ..... 340/331
5,598,139 A 1/1997 Karim et al.
5,608,375 A 3/1997 Kosich
5,673,030 A 9/1997 Kosich
5,751,210 A 5/1998 Kosich
5,850,178 A 12/1998 Ha et al.
5,982,275 A 11/1999 Kosich
6,311,021 B1 * 10/2001 Kosich ..... 396/164

* cited by examiner

*Primary Examiner*—Wilson Lee
(74) *Attorney, Agent, or Firm*—Welsh & Katz, Ltd.

(57) ABSTRACT

A strobe light responds to both an input voltage range of about 8–40 volts and a selectable candela output. A programmed processor stores a plurality of electrical parameters which correspond to respective selectable candela. For repetitive fixed periods, the light is repetitively driven by a variable duty cycle signal that takes into account both applied voltage and selected candela output.

30 Claims, 13 Drawing Sheets

1 SECOND FLASH
1 SECOND FLASH
1 SECOND FLASH
TARGET BULB VOLTAGE
52
PULSE WIDTH DETECTION VOLTAGE POINT
50
DC VOLTS

PULSE WIDTH OVER 0.75 SECOND CUTOFF
TARGET PULSE WIDTH (MS)
MAX ERROR
TARGET PULSE WIDTH
PULSE WIDTH = TARGET
ERROR

T1(US)
T1
CORRECTION #1
T2 = T1+CORRECTION #1
T2
CORRECTION #2
T3 = T2+CORRECTION #2
T4 = T3

DC VOLTS
TARGET BULB VOLTAGE
1 SECOND FLASH
60
VOLTAGE ERROR
A TO D CONVERSION
1 SECOND FLASH
VOLTAGE ERROR
A TO D CONVERSION
1 SECOND FLASH
NO ERROR
A TO D CONVERSION

T1(US)
T1
CORRECTION #1
T2 = T1+CORRECTION #1
T2
CORRECTION #2
T3 = T2+CORRECTION #2
T4 = T3

PROCESSOR CONTROLLED STROBE

FIELD OF THE INVENTION

The invention pertains to strobe lights driven by programmed processors. More particularly, the invention pertains to such strobes which respond to variable input voltages and selectable levels of candela output.

BACKGROUND OF THE INVENTION

Circuits for driving strobe lights of a type usable in alarm systems are known. Some known circuits charge a capacitor using constant frequency, variable current signals. Others have incorporated a coil in combination with frequency varying circuits. One known system has been disclosed in U.S. Pat. No. 5,850,178, issued Dec. 15, 1998, entitled "Synch Module With Pulse Width Modulation" and assigned to the assignee hereof.

Known circuits have been designed to be driven from a single nominal voltage such as 12 volts or 24 volts. In addition, known circuits have been designed to drive a gas filled tube to produce a single, nominal candela output.

There is a need for more flexible strobe drive circuitry. Preferably a single drive circuit could accommodate a range of nominal input voltages. In addition, it would be desirable to be able to select from a range of desirable candela output levels without regard to available input voltage.

Preferably, the above noted features could be implemented so as to promote manufacturability. It would also be preferable if such flexibility did not appreciably increase unit cost.

SUMMARY OF THE INVENTION

A strobe drive circuit combines circuits to accept variable input drive voltages with circuitry responsive to selectable candela output levels. In one aspect, the circuitry monitors the time to charge a capacitor to a selected, predetermined voltage. In another aspect, the actual capacitor voltage is monitored. A gas filled tube can be triggered at the appropriate voltage. Other types of visible output devices could also be used.

The charging duty cycle can be varied to respond to various input voltages as well as differing predetermined flash voltages. The duty cycle of the drive current is continually corrected with each flash.

In one embodiment, surge currents are substantially eliminated by starting with a lower duty cycle and increasing same over time, with each flash. With this configuration, power supply fold back or over-current conditions can be substantially eliminated.

In another aspect, the charging current duty cycle can be incremented one or more times from an initial value while charging the capacitor. Simultaneously, the capacitor's voltage can be monitored. Depending on the results, for example the value of the flash voltage of the present flash cycle, the current charging current duty cycle can be altered for the next flash cycle.

A programmed processor can be incorporated into the control circuitry. Information can be stored relative to a plurality of available candela outputs. When a specific output has been selected, corresponding pre-stored information is used by the processor to charge the capacitor to the respective output voltage.

In another embodiment, the capacitor voltage can be measured, digitized in an A/D converter, and compared to a plurality of pre-stored values. In response to the comparison step, charging current duty cycle can be altered.

The control process also responds to input voltage variations. With a lower input voltage, the charge current duty cycle will increase to provide the necessary capacitor voltage. With a larger input voltage, the duty cycle will decrease.

A control method includes the steps of establishing a plurality of target pulse widths based on respective candela outputs; selecting a candela output level; charging an energy source until either a selected voltage is reached or until a predetermined time interval has ended; keeping track of the actual charging time interval; comparing the actual charging time interval to the target pulse width associated with the selected candela output; where the actual time interval is less than the target pulse width, decreasing the charging parameter a selected amount and where the actual time interval is greater than the target pulse width, increasing the charging parameter.

Where the selected voltage is repetitively reached before the predetermined time interval has ended, the charging parameter can be repetitively reduced. This reduction can be via a decreasing amount. Where the predetermined time interval repetitively ends before the selected voltage has been reached, the charging parameter can be repetitively increased.

In another embodiment, capacitor voltage can be digitized and compared to a candela specific target value. Depending on the results of this comparison, charging duty cycle can be altered.

In either embodiment, the closed loop control system responds to variations in input voltage. Charging duty cycle is adjusted in response thereto to maintain a selected candela output level. Variations in the input voltage in a range on the order of 4:1 can be accommodated.

Desired candela output level can be manually set at a unit. Alternately, it can be downloaded to a unit, as a programmable parameter, from a remote source.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 2A-1 is an overall flow diagram of a method illustrating one form of operation of the system of FIG. 1;

FIG. 2A-2 is an over-all flow diagram of a method illustrating an alternate form of operating the system of FIG. 1;

FIG. 4-1 is a flow diagram illustrating a candela adjustment process in accordance with the method of FIG. 2A-1;

FIG. 4-2 is a flow diagram illustrating a candela adjustment process in accordance with the method of FIG. 2A-2;

FIGS. 5-1, 5-2, and 5-3 are timing diagrams which taken together illustrate candela target searching for raising a bulb voltage to a target voltage in accordance with the method of FIG. 2A-1;

FIGS. 6-1, 6-2, 6-3 are timing diagrams which taken together illustrate candela target searching for lowering a bulb voltage to a target voltage in accordance with the method of FIG. 2A-1;

FIGS. 7-1, 7-2, are timing diagrams which taken together illustrate candela target searching for raising a bulb voltage to a target voltage in accordance with the method of FIG. 2A-2;

FIGS. 8-1, 8-2 are timing diagrams which taken together illustrate candela target searching for lowering a bulb voltage to a target voltage in accordance with the method of FIG. 2A-2;

DETAILED DESCRIPTION OF THE PREFERRED EMBODIMENTS

Figure 1:
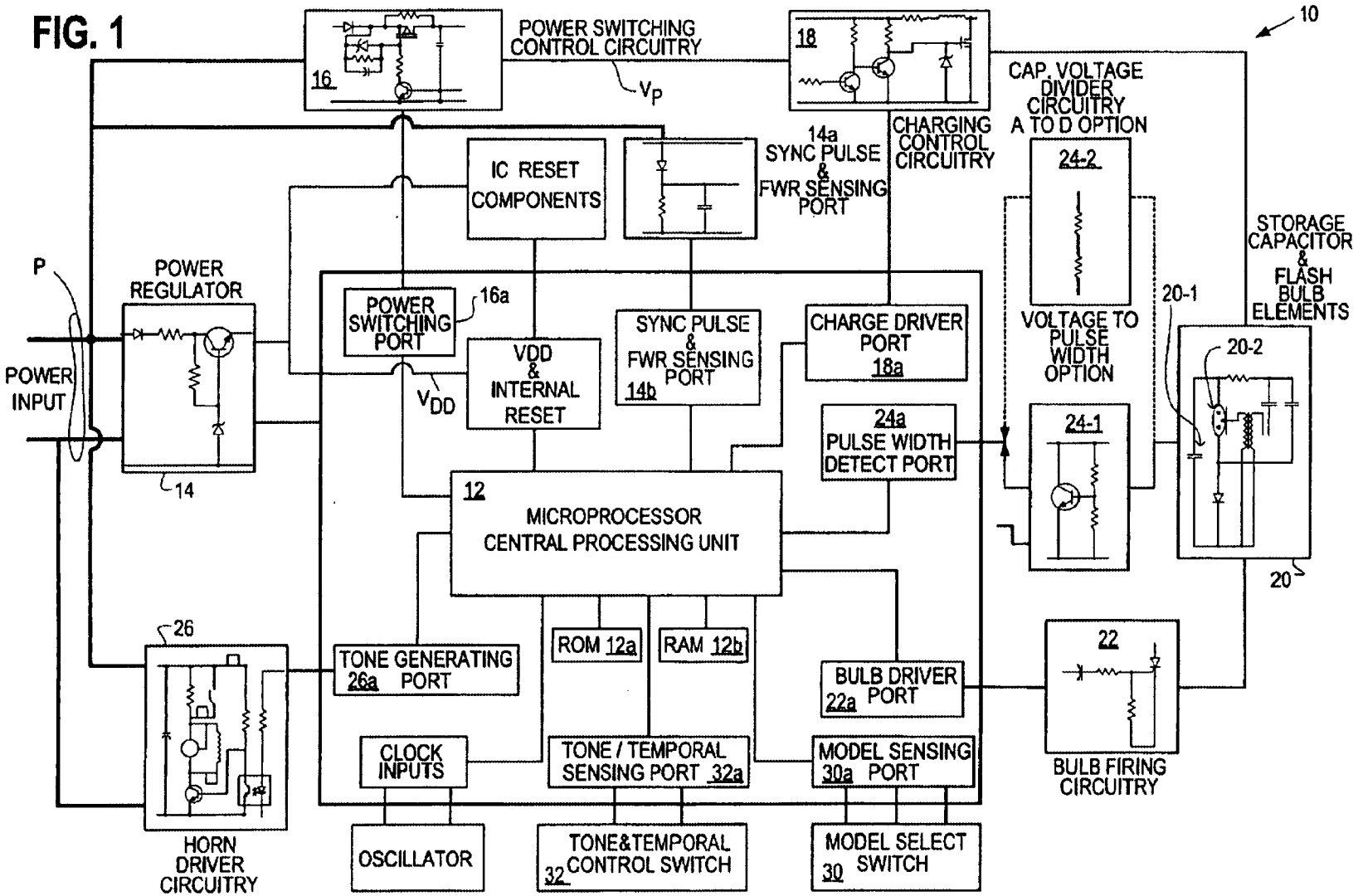
FIG. 1 is a block diagram of a system, having two feedback options, in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a block diagram of two embodiments of a system 10, a multi-candela visual output device. The system 10 includes a control element, for example a programmable processor, 12.

The processor 12 is coupled to a read-only or programmable read-only memory 12*a* and read/write memory 12*b*. Memory units 12*a*, 12*b* can store executable instructions for carrying out methods discussed subsequently as well as parameters and results of on-going calculations.

A power regulator 14 is coupled to power input lines P. Exemplary circuitry, as would be understood by those of skill in the art, is illustrated in various of the circuit blocks, such as circuit block 14.

Lines P provide electrical energy and synchronization pulses. Lines P can be coupled to a fire alarm control unit or other control devices.

The voltage on the lines P can vary, for example, between 8–40 volts DC. The principles of the present invention can be used with other ranges of input voltages and can be used with half wave or full wave rectified AC input voltages in a range of 10–33 volts RMS without departing from the spirit and scope of the present invention.

As discussed below, system 10 automatically adjusts to various input voltages. Thus, it can be powered without any changes off of 12 volts DC, 24 volts DC or 24 volts RMS rectified AC.

Power control circuitry 16 is coupled to lines P and to charging control circuitry 18. Processor 12 is coupled to circuitry 16 via port 16*a* and to charging control circuitry 18 via port 18*a*. Processor 12 is coupled to regulator 14 via sync pulse port 14*a* and sensing port 14*b*.

The charging control circuit 18 is coupled to circuits 20 which include capacitor 20-1 and flash bulb or tube 20-2 and provides electrical energy to charge the capacitor therein using, for example either a variable or a constant frequency, variable duty cycle signal. Bulb firing circuitry 22 is coupled via driver port 22*a* to processor 12. Where the capacitor in element 20 has been charged to a predetermined value, based on selected candela output, the processor 12 can trigger, or flash the bulb via port 22*a*.

In one embodiment, voltage to pulse width feedback circuitry 24-1 provides feedback, in the form of a downgoing voltage, to processor 12 which indicates that the voltage across the capacitor, element 20-1, has reached a predetermined value. This is a value which is independent of selected candela output. As discussed subsequently, this feedback signal, be coupled to processor 12 via port 24*a*, can be used to adjust a charging current duty cycle via control circuitry 18.

In a second embodiment, an analog-to-digital converter, integral to processor 12 or as a separate circuit, can convert flash bulb or tube voltage across capacitor 20-1, reduced by divider circuit 24-2, to a digital value. This digital, capacitor voltage value can be compared to a candela related target value, selected by switch 30, and the results thereof used to adjust a charge current duty cycle.

Horn driver circuit 26, via port 26*a* is coupled to processor 12 and enables the processor 12 to drive an audible output device in accordance with a preselected tonal pattern. The pattern can be synchronized by synchronizing signals received at port 14*b*.

Model select switch 30, via port 30*a* is coupled to processor 12. Switch 30 can be set, locally or remotely to specify one of several selected candela outputs, such as 15, 30 or others of interest.

Temporal control switch 32 can be set to select an audible tonal output pattern. Switch 32 is coupled to processor 12 via port 32*a*.

Figures 1, 2, 2A:
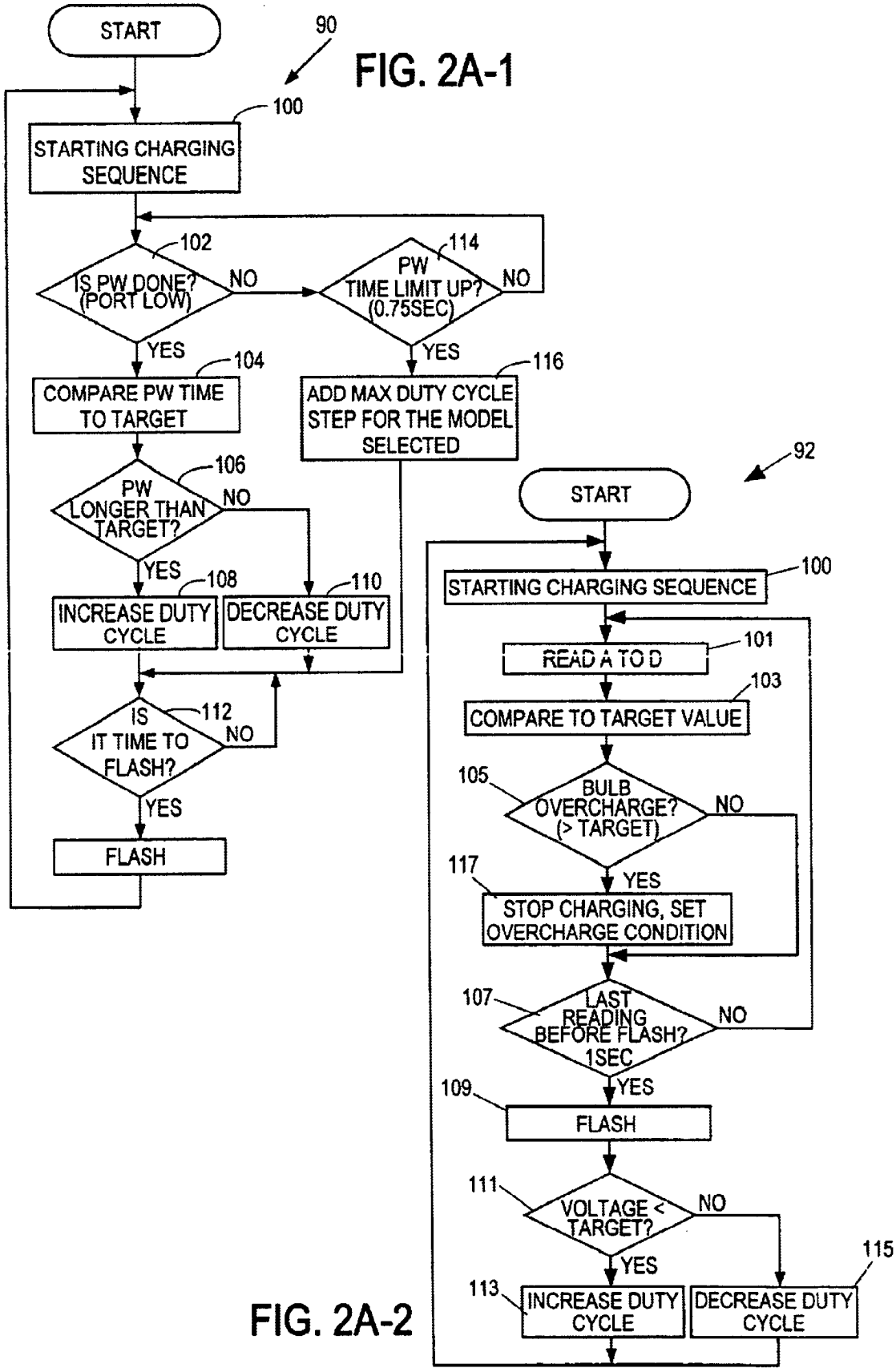

FIGS. 2A-1 and 2A-2 illustrate two different control processes 90, 92 in accordance with the present invention. Those of skill will understand that the processes are periodic. An exemplary one second cycle is disclosed and discussed, see FIG. 10. It will be understood that other periods or cyclic intervals could be used without departing from the spirit and scope of the present invention.

FIG. 2A-1 illustrates steps of a method 90 of operating system 10 using feedback circuit 24-1. In an initial step 100 a capacitor charging sequence is started. In step 102, circuitry 24-1, via port 24*a* is checked. If low, the capacitor voltage has reached a predetermined value (the same for all candela output). If low, in step 104, the feedback signal time to transition from high to low is compared to a target value.

In a step 106 if the feedback transition time interval exceeds the target parameter, the capacitor is not being charged quickly enough and the duty cycle for charging the capacitor is increased in a step 108. If the feedback transition time interval is less than the target parameter, the capacitor is being charged to quickly and the duty cycle for charging the capacitor is decreased in a step 110. Subsequently, in step 112 the tube, element 20-2, is flashed.

If the feedback signal from circuit 24-1 is high in step 102, in step 114, feedback signal time to transition is compared to a maximum interval of 0.75 second. If at the limit, in a step 116, duty cycle is increased a maximum amount based on selected candela output.

In summary, with respect to process 90:

1. When a specific candela is selected, the executable instructions assign a target pulse width value (discussed in more detail subsequently, FIGS. 5-2 and 6-2). As each flash occurs, the conversion for bulb voltage to pulse width begins. After the conversion is complete, the result is used to compare to the target pulse width value.

2. If the result pulse width value is more than the target value, the charging on duty value will increase. This increase in the duty cycle causes the charging to increase and as a result, the pulse width decreases. The amount of duty cycle increase depends on how far the actual pulse width is from the target. The further away the target pulse width is, the more the increase will be applied to charging.
3. The opposite of step 2 occurs if the result pulse width value is smaller than the target value. The duty cycle will now decrease to slow down the rate of the charging.

The charging adjustment continues at each flash until the final target value is reached and dynamically adjusts the duty value in order to keep the pulse width equal to the target value. The process of reaching the target pulse width allows the system to track any input voltage in the specified range for that candela, discussed in more detail subsequently, see FIG. 9.

FIG. 2A-2 illustrates an alternate process 92 which uses divider circuitry 24-2 and an associated analog-to-digital converter. A charging sequence is initiated in the step 100.

The feedback value, via circuits 24-2 is read and converted, step 101. The digitized value is compared to a pre-stored target value, step 103.

If the feedback voltage has not exceeded the target value, step 105, a comparison is made in step 107 to a flash interval, for example a one second interval, and if appropriate the tube is flashed in step 109.

If the feedback voltage is less than the target value, step 111, the duty cycle is increased, step 113. If not, it is decreased, step 115. Bulb voltage is compared to a maximum in a step 117. If too large, the capacitor can be discharged.

Figure 2B:
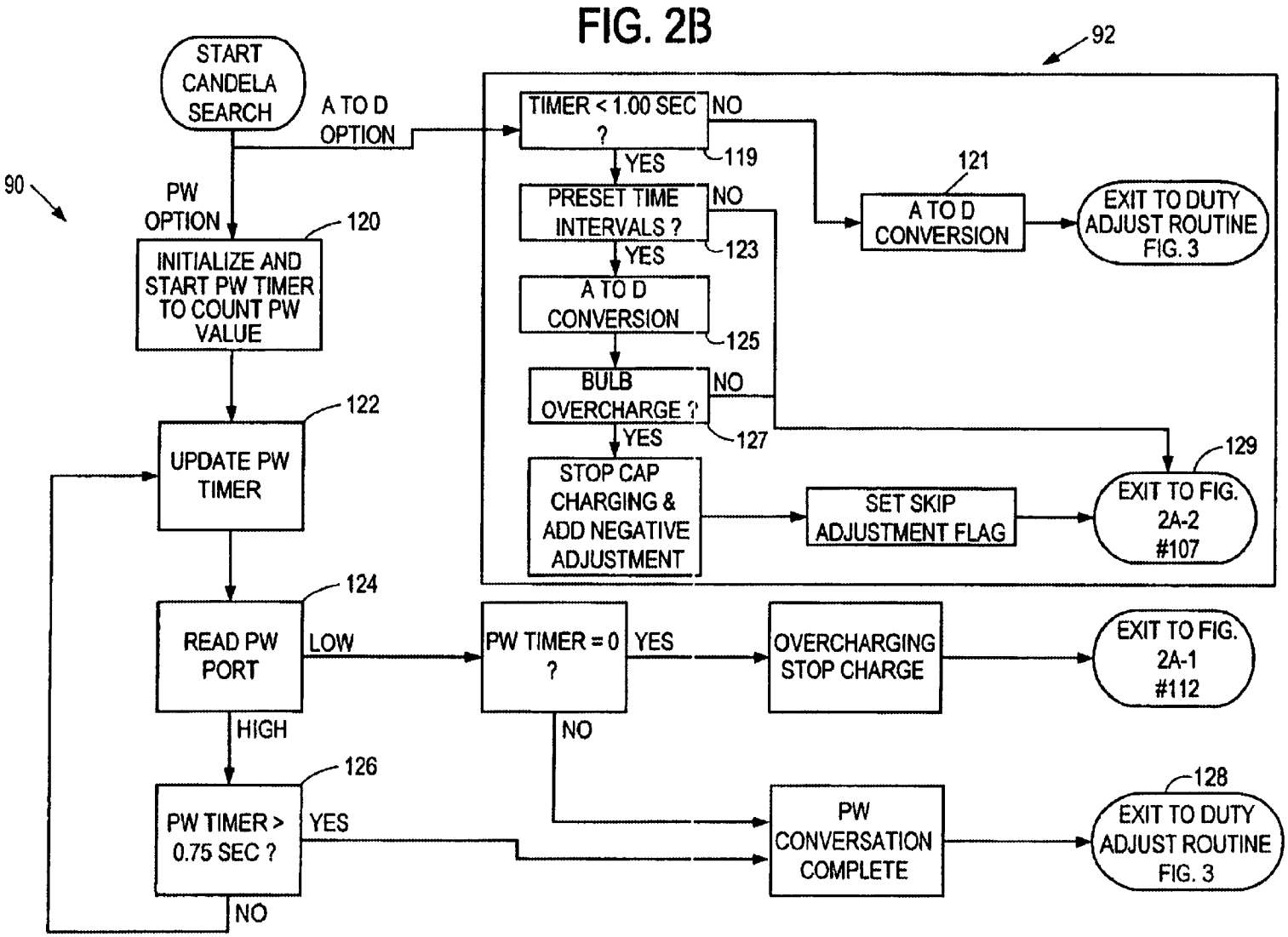
FIG. 2B is a flow diagram illustrating additional details of the methods of FIGS. 2A-1 and 2A-2.
Figure 10:
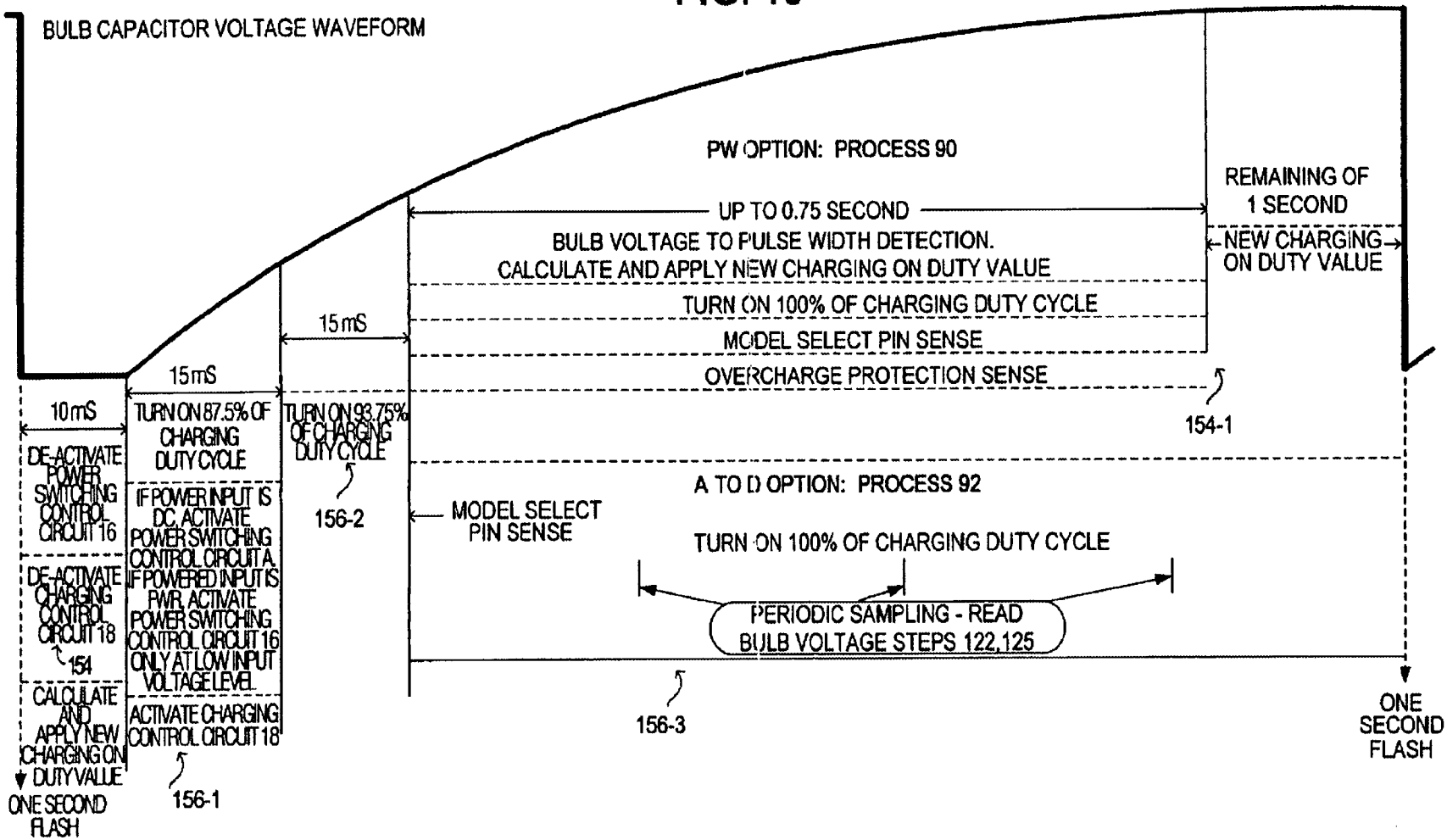
FIG. 10 illustrates additional aspects of the methods of FIGS. 2A-1, -2.

FIG. 2B illustrates additional aspects of the steps of the method 90 of FIG. 2A-1 and of alternate process 92, FIG. 2A-2. FIG. 10 illustrates additional details of processes 90, 92 on a per-cycle basis.

Figure 3:
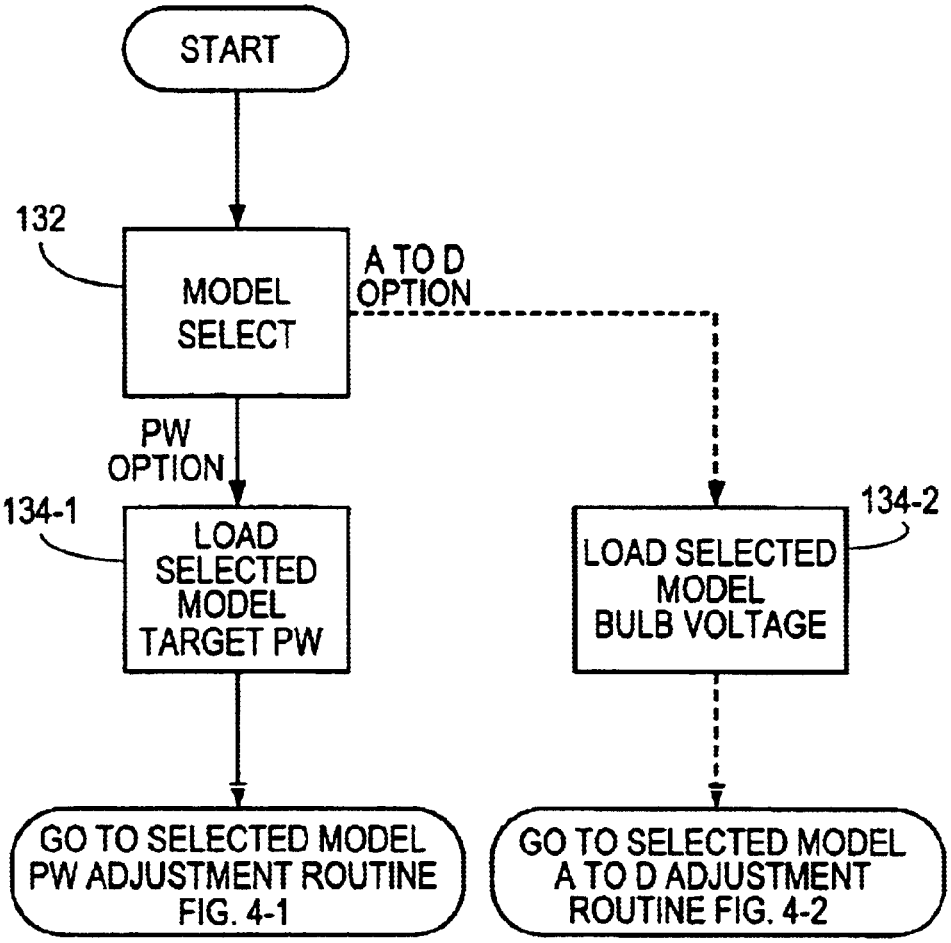
FIG. 3 is a flow diagram illustrating selection of an adjustment routine.

With respect to process 90, in step 120 the timer is initialized. In a step 122 it is incremented. In a step 124 the feedback signal, from element 24 is evaluated. If high, the target voltage has not net been reached and the contents of the timer are compared in a step 126 to 0.75 seconds. If less than or equal, the process returns to step 122. If not, the process exits, step 128, and duty cycle adjust routine is initiated, see FIG. 3. Where the pulse width port indicates in step 124 that the capacitor is exhibiting a predetermined voltage, if the timer contents are non-zero the duty adjust routine of FIG. 3 is initiated step 128.

With respect to process 92, if the time equals or exceeds 0.9 seconds, step 119, an analog-to-digital conversion takes place, step 121. The duty cycle adjust routine, FIG. 3, is then entered.

In steps 123, 125, an analog-to-digital conversion takes place multiple times in each charging cycle at preset time intervals. In the absence of a detected overvoltage condition, step 127, the sample time of the latest voltage value is compared to the latest possible sample time for each cycle, step 107, to determine if a flash cycle should be initiated.

Figures 1, 2, 7:
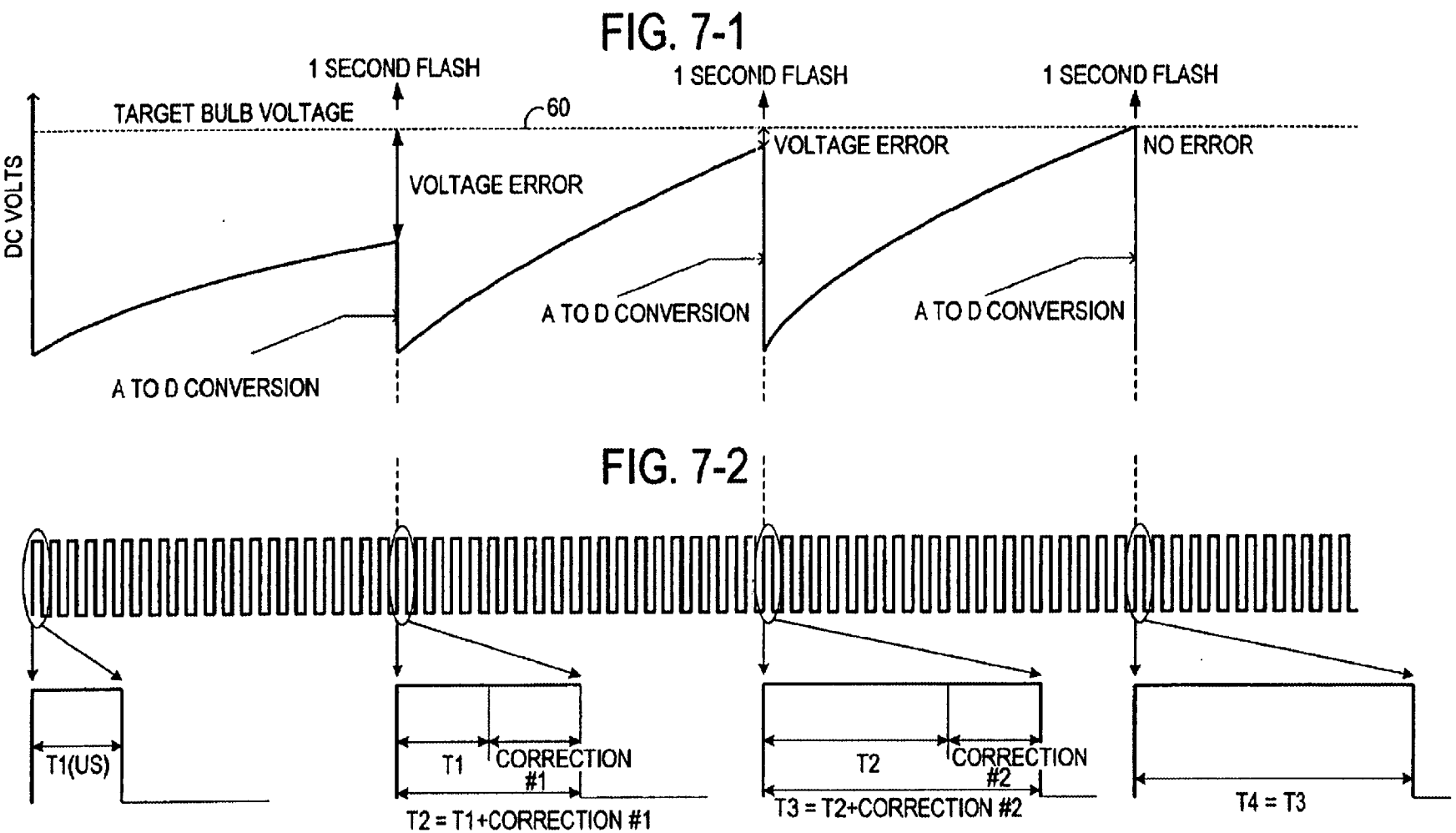

In summary, with respect to process 92:

1. When a specific candela is selected, the executable instructions assign a target bulb voltage (see #60, FIG. 7-1 and 8-1). As each flash occurs, the conversion for bulb voltage to pulse width begins, after the conversion is complete, the result is used to compare to the target pulse width value.
2. If the result bulb voltage value is more than the target value, the charging on duty value will increase. This increase in the duty cycle causes the charging to increase and as a result, the bulb voltage increases. The amount of duty cycle increase depends on how far the actual bulb voltage is from the target. The further away the target bulb voltage is, the more the increase will be applied to charging.
3. The opposite of step 2 occurs if the result bulb voltage value is smaller than the target value. The duty cycle will now decrease to slow down the rate of the charging.

The charging adjustment continues at each flash until the final target value is reached and dynamically adjusts the duty value in order to keep the bulb voltage equal to the target value. The process of reaching the target bulb voltage allows the system to track any input voltage in the specified range for that candela.

The capacitor voltage is continuously monitored with the A to D to prevent overcharging. In the event that the capacitor voltage is greater than the target value, the charging will be stopped until the voltage drops below the target. The duty cycle will be adjusted at the beginning of the next charge cycle.

FIG. 3 illustrates evaluating the selected candela output specified, for example by setting switch 30, in step 132. The respective target pulse width is retrieved from storage units 12*a,b* step 134-1 or the respective target bulb voltage is retrieved from storage, step 134-2. The respective adjustment routine is then entered in one of FIGS. 4-1 and 4-2.

Figures 1, 4:
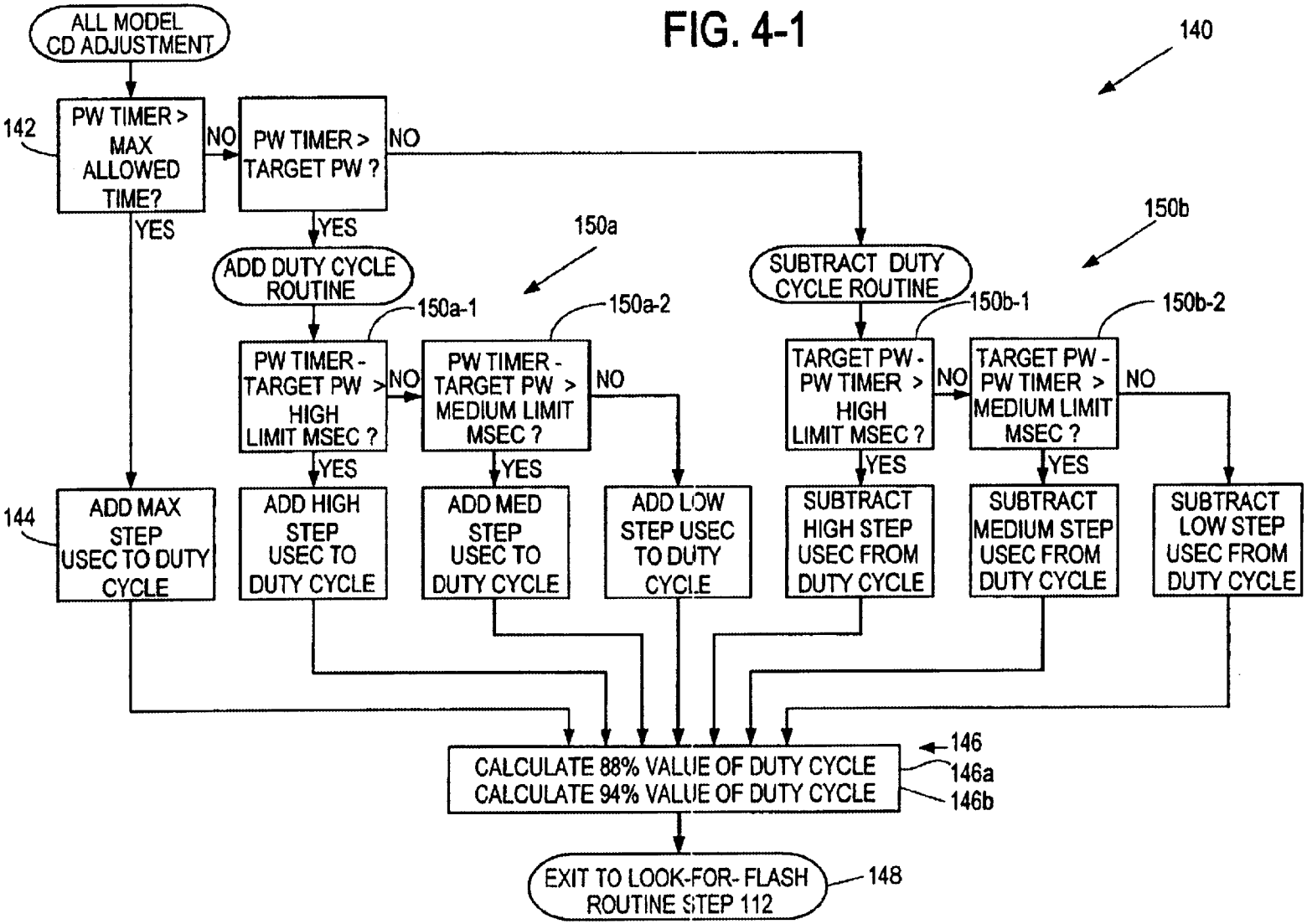
Figures 2, 4:
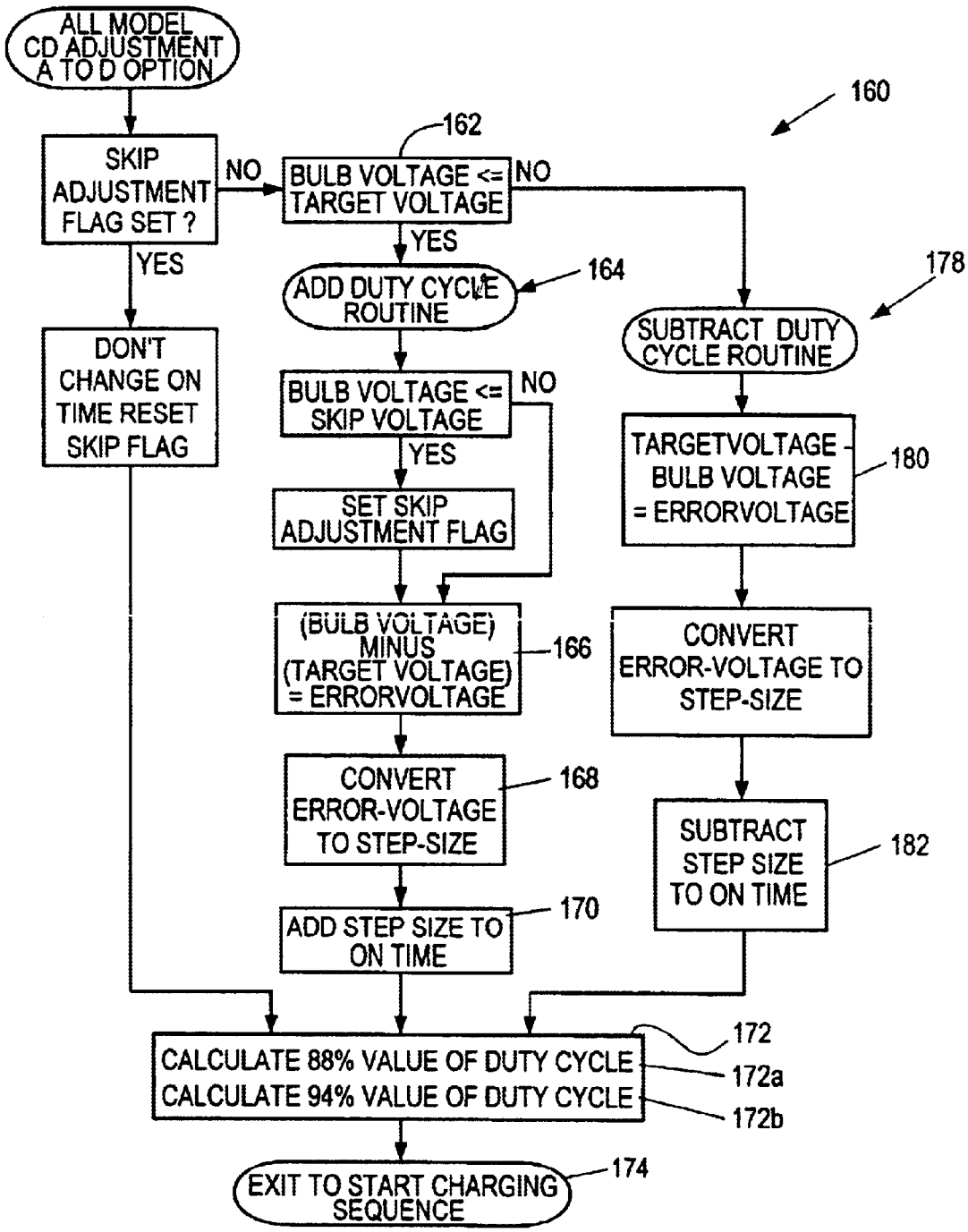

FIG. 4-1 illustrates steps 140 in adjusting the capacitor charging duty cycle parameter for respective settings of candela output where pulse width feedback circuitry 24-1, process 90, has been implemented. FIG. 4-2 illustrates steps in adjusting capacitor duty cycle for respective settings of candela output where analog-to-digital converter, process 92 has been implemented. It will be understood that model selection can also take place electronically, perhaps via a message received via power lines P in addition to or as an alternate to a locally settable switch or element.

In FIG. 4-1 in step 142 the contents of the timer buffer are compared to a maximum allowed time, such as 0.75 sec. If they exceed the threshold, in step 144 the duty cycle is increased by a maximum increment, for example 20 microseconds.

In step 146, substep 146*a* is a calculation to establish 88% of the current duty cycle. In step 146*b* 94% of the current duty cycle is determined. These two values are used in the next cycle, illustrated in FIG. 10, to ramp up the charging current from a minimal value, to a full 100% value. Step 148 is an exit to the flash routine. Other values could be used without departing from the spirit and scope of the present invention.

Steps 150*a* address a condition where the contents of the timer buffer exceed the target pulse width parameter for the respective candela value. Steps 150*b* address a condition where the contents of the timer buffer are less than the target pulse width parameter for that candela value.

Figures 1, 2, 3, 5:
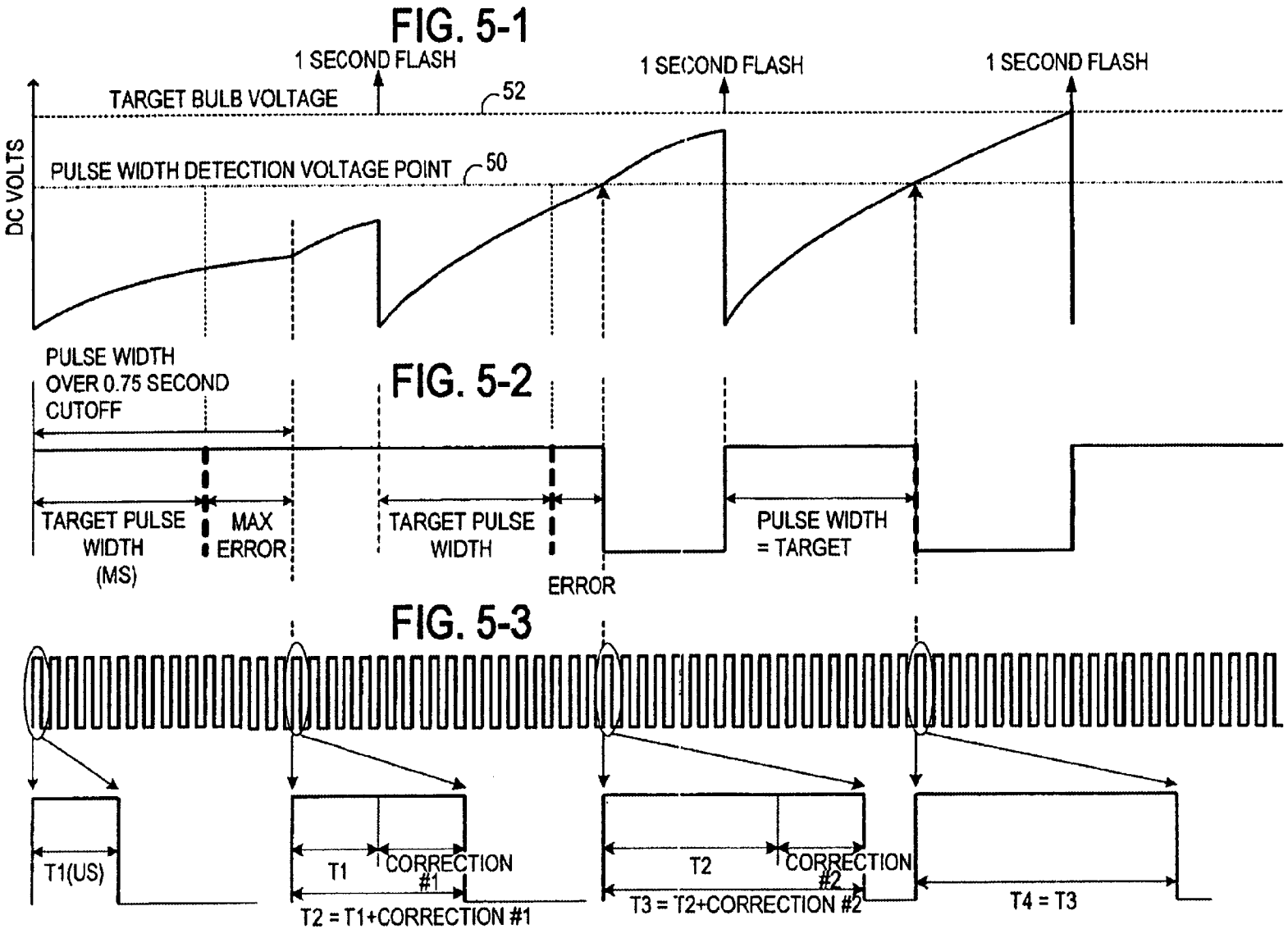

With respect to steps 150*a* and timing diagrams of FIGS. 5-1 to 5-3, in steps 150*a*-1, -2 the degree to which the pulse count exceeds the target pulse count is determined. As illustrated in FIG. 5-2, the duty cycle of the charging current should be increased to accelerate the increase of voltage on the capacitor. The duty cycle increase takes place immediately, see FIG. 5-3. The capacitor continues to charge and one second after the last trigger signal, the next trigger signal is issued by the processor 12, via circuitry 22 irrespective of the then capacitor voltage value, by the flash routine, step 148.

At the start of the next cycle, charging of the capacitor is initiated at 88% of the duty cycle, step 146*a* (see also FIG. 10). Subsequently after a selected time interval, as would be understood by those of skill in the art, the charging rate in increased to 94% of the duty cycle, step 146*b*. Then the charging rate is increased to 100% of the duty cycle, FIG. 5-3.

With a one second flash period, FIG. 5-1, the capacitor could be charged at the 88% and 94% levels for 15 milliseconds. Other time intervals could be used without departing from the spirit and scope of the present invention.

Once the capacitor has been discharged a surge of current may result when trying to recharge it. By starting each charge cycle, after a discharge, at a lower rate and increasing the current (by increasing the percent of the duty cycle) overcurrent or surge current problems can be minimized. This process minimizes power supply fold-back or shut down problems.

Figures 1, 2, 3, 6:
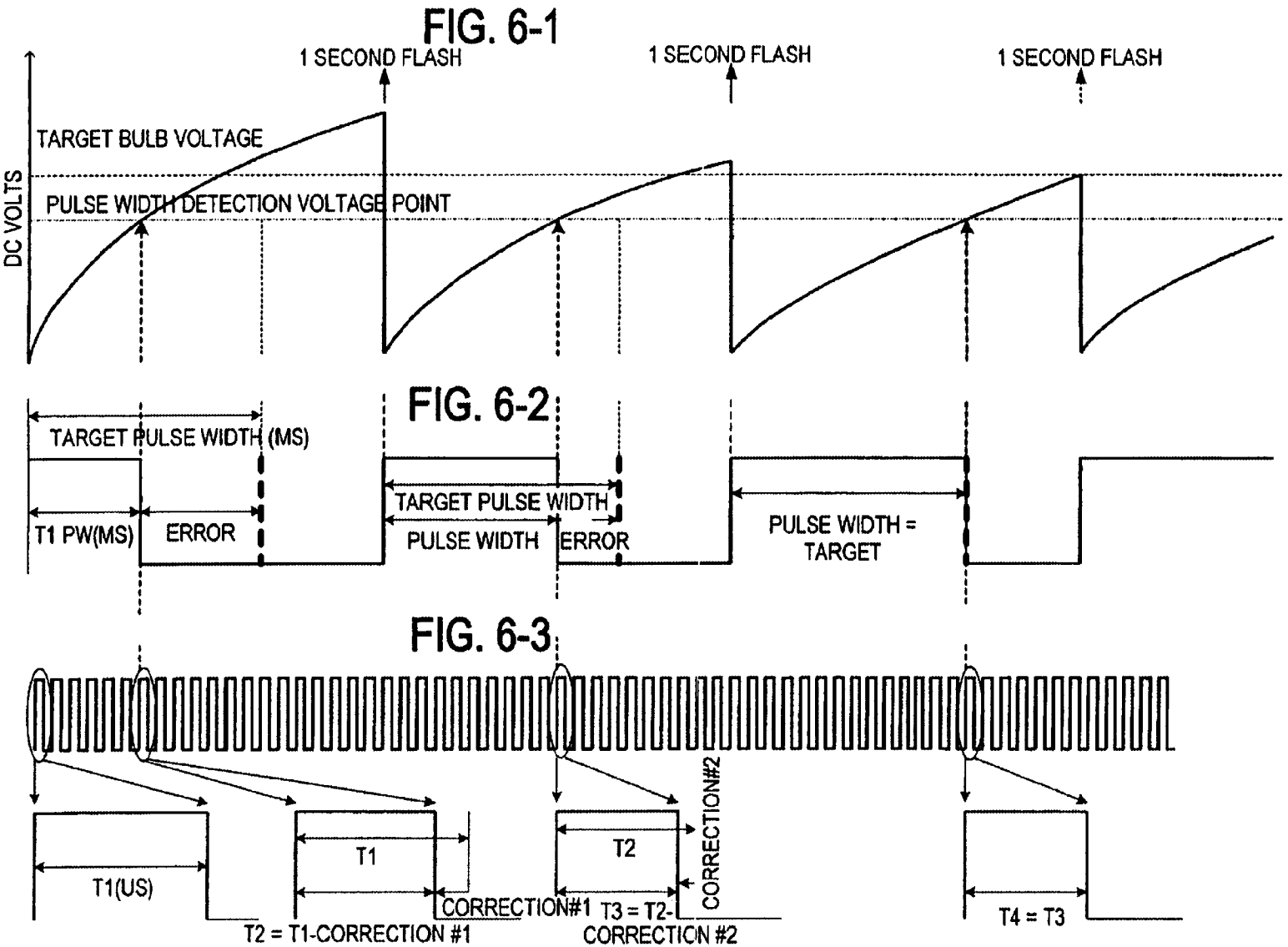

Steps 150*b*, and FIGS. 6-1 to 6-3, illustrate the operation of system 10 where the value of the target pulse width exceeds the contents of the pulse width timer. In this circumstance, the voltage across the capacitor has crossed the threshold before the 0.75 second interval. As illustrated in FIG. 6-1, the voltage across the capacitor has increased too quickly. Depending on the difference between the target pulse width and the measured pulse width, steps 150*b*-1, -2, the duty cycle will be decreased, FIG. 6-3.

Figure 9:
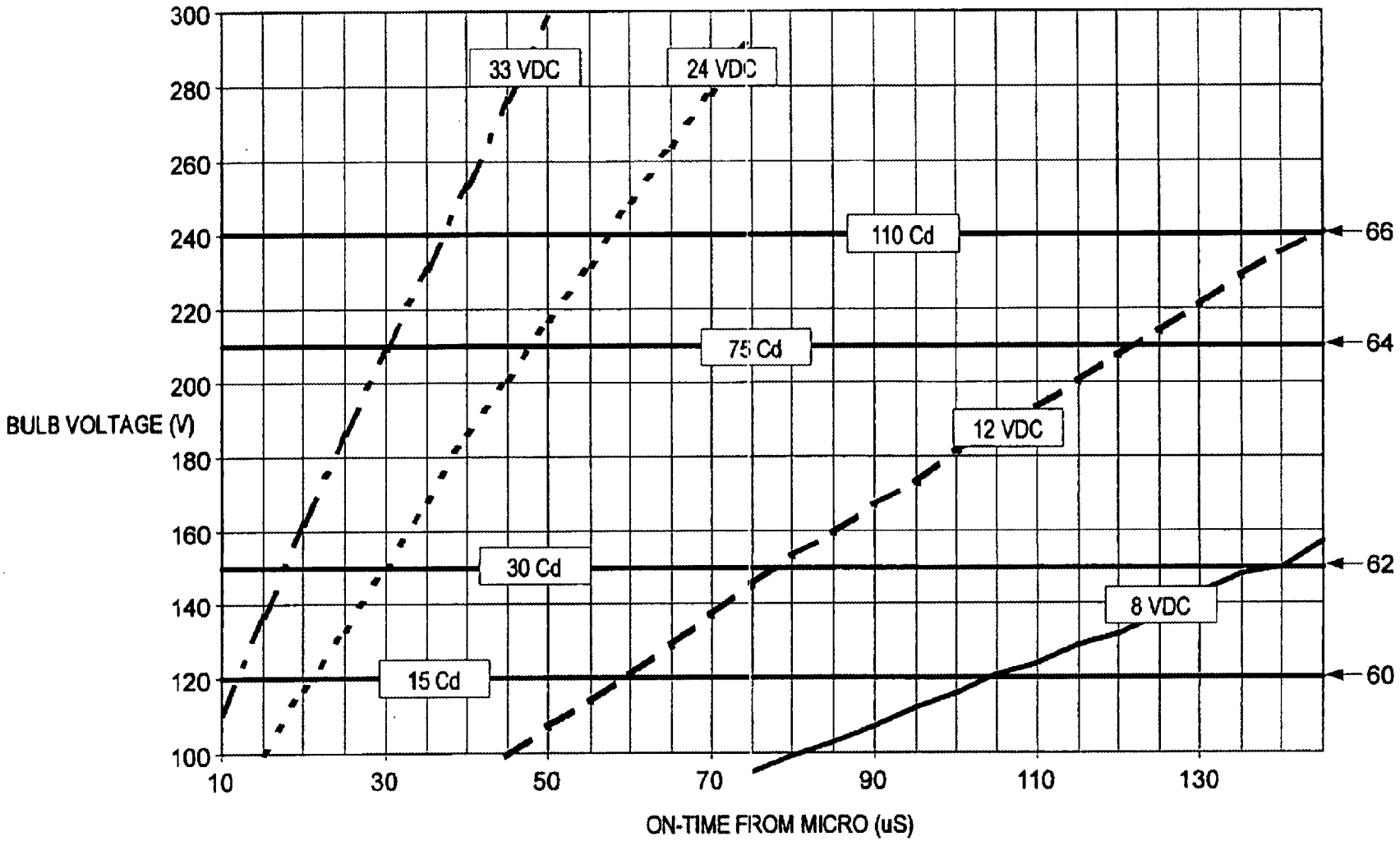
FIG. 9 is a series of graphs illustrating flash bulb voltage plotted against on-time for charging the bulb capacitor.

The above described process also automatically responds to variations in input voltage P. In FIG. 9, bulb trigger voltages have been plotted against on-time for charging the respective capacitor. Lines 60–66 indicate necessary voltage to flash the tube, circuitry 20, to produce the respective indicated candela output.

As illustrated in FIG. 9, duty cycle, on-time, is automatically adjusted to track input voltages ranging, for example, from 8–33 volts DC or 8–33 volts RMS, full wave rectified AC. The control process substantially maintains light output and flash tube trigger voltage at preselected values even in the presence of such variations.

As the voltage decreases, the on-time will be automatically be increased to provide increased current to charge the capacitor. Where the period of the charging current is, for example 160 microseconds, the 10–135 microsecond variation, plotted against the X axis, FIG. 9, illustrates the increase in duty cycle necessary to compensate for falling input voltage.

The steps of FIG. 4-2 in combination with FIGS. 7-1, -2 and 8-1, -2 illustrate steps 160 of the duty cycle adjustment process where an analog-to-digital converter is used in combination with divider circuitry 24-2, process 92. In a step 162, actual bulb voltage, digitized, is compared to a preselected, candela related, output voltage. If less than the target voltage, the steps of Add Duty Cycle routine 164 are executed, see FIGS. 7-1, -2.

At the end of each flash cycle, for example one second (see FIG. 10), in the add duty cycle routine, in step 166 the error voltage is determined by subtracting actual capacitor voltage from a pre-stored, candela specific, target voltage 60. In a step 168 a step size is determined by dividing the error voltage by a constant as would be understood by those of skill in the art. The resultant step size is added to the current "on-time" (T1 in FIG. 7-2) in a step 170 to form the "on time" for the next cycle, see FIG. 10.

In step 172 to ramp up to full duty cycle over a period of time, 88% of full duty cycle is determined in step 172 and 94% in step 172*b*. The process 160 terminates for the current cycle with an exit, step 174 to the flash routine.

As illustrated in FIG. 10, for both processes 90, 92, at the start of the next cycle, interval 154, circuits 16, 18 are deactivated. During interval 156-1 the circuits 16, 18 are energized for 87.5% of the current duty cycle. This is increased to 93.75% of current duty cycle, interval 156-2. During interval 156-3, the capacitor is charged at 100% of the current duty cycle.

When carrying out process 90, the adjustment to the duty cycle is made during the current cycle, at the end 154-1 of the 100% charging duty cycle interval. When carrying out process 92, the adjustment to duty cycle is made at the beginning of the next cycle, time interval 154.

Figures 1, 8:
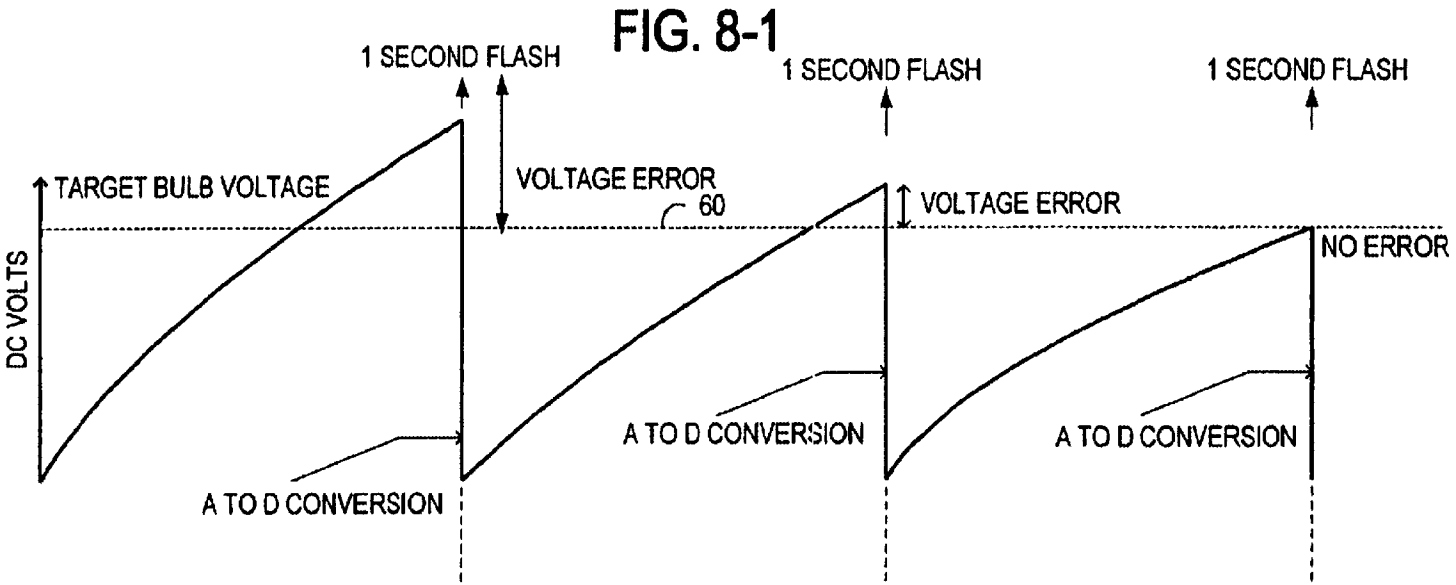
Figures 2, 8:
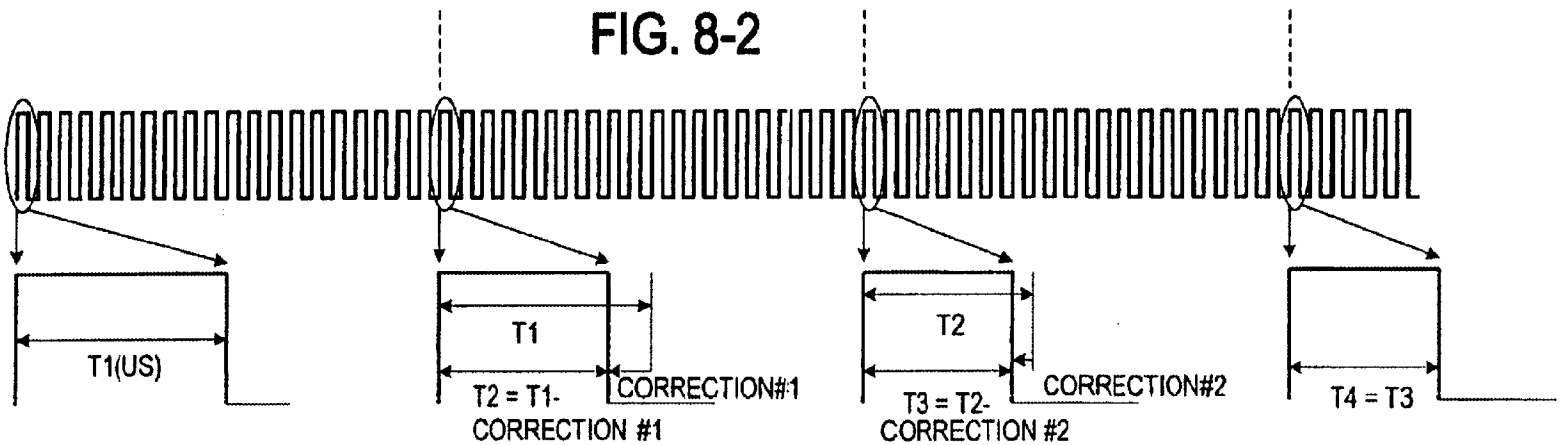

With respect to FIG. 4-2, where the bulb voltage exceeds the target voltage, FIGS. 8-1 and 8-2, the steps 178 of the Subtract Duty Cycle Routine are executed. An error voltage is determined in step 180. The error voltage is, in an exemplary embodiment, subtracted from the on time, reducing the duty cycle in a step 182 before making the step 172 calculations and exiting.

The above described process continues between flashes until the final target value is reached. The system 10 continues to dynamically adjust the duty cycle in order to keep the pulse width equal to the target value, or, to keep actual capacitor voltage equal to a candela dependent target value. It will be understood that previously discussed parameters for incrementing the duty cycle are exemplary only and could be varied without departing form the spirit and scope of the present invention.

It will also be understood that the control process of reaching and maintaining the target pulse width, or, alternately, reaching and maintaining the target voltage enables the system 10 to track varying input voltages in the lines P as illustrated in FIG. 9. At any time, if the capacitor voltage exceeds a preset value, charging will be temporarily halted and the flash tube flashed thereby discharging the capacitor.

Figure 11:
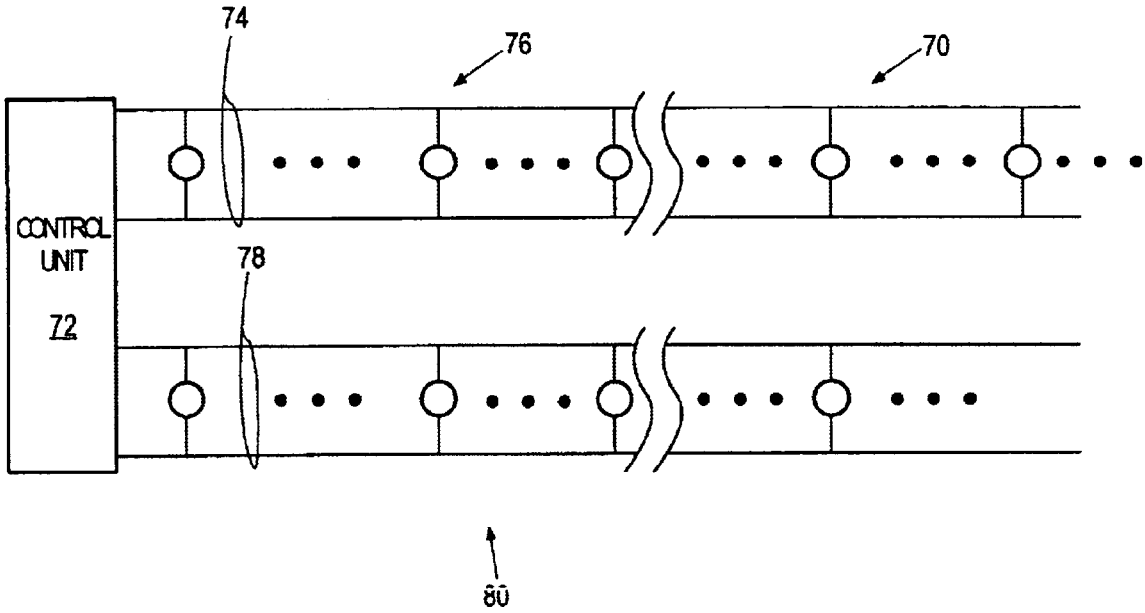
FIG. 11 is a block diagram of a system in accordance with the invention.

FIG. 11 illustrates a monitoring system 70 which includes a common control element 72, a bidirectional communications link 74 and a plurality of electrical units 76. The plurality 76 can include ambient condition detectors, such as fire detectors. Information pertaining to detected fires can be coupled to the control element 72 via link 74.

A second communications link 78, coupled to control element 72 is also coupled to the members of a plurality 80 of output devices, such as the apparatus 10. The link 78 can provide electrical energy to the members of the plurality 80 as well as synchronizing signals. The control element 72 can supply electrical energy to the link 78.

It will also be understood that units 80, such as the device 10 can also be coupled to the link 74. In this embodiment, the units 80 not only receive power from the link 74, they can receive messages from and send messages to members of the plurality 76. Even though they are coupled to link 74, if desired units 80 can continue to receive power from a separate source.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. A strobe comprising:

a housing;

a gas filled tube;

a capacitor coupled to the tube;

a candela specifying element;

input terminals for receipt of voltages in a range of 10–30 volts; and control circuitry carried in the housing, coupled to the capacitor, the specifying element and the input terminals;

wherein the control circuitry includes a capacitor voltage feedback circuit, and in response to a feedback signal therefrom, incrementally alters a capacitor charging parameter for a subsequent charging cycle so as to produce the specified candela when the tube is energized.

2. A strobe as in claim 1 wherein the control circuitry stores parameters indicative of each specifiable candela.

3. A strobe in accordance with claim 2 including circuitry for energizing the tube in accordance with the specified candela.

4. A strobe as in claim 1 which includes circuitry responsive to the voltage applied to the terminals for energizing the tube in accordance with the candela specifying element.

5. A strobe as in claim 4 wherein the control circuitry includes a programmed processor and storage for output parameters associated with respective specifiable candela.

6. A strobe as in claim 5 wherein the processor executes pre-stored instructions for altering a charging rate of the capacitor in response to a selected output parameter.

7. A strobe as in claim 6 wherein the control circuitry illuminates the tube, at least at a first predetermined rate, and wherein the instructions alter the charging rate between illuminations.

8. A strobe as in claim 7 wherein the instructions repetitively increase the charging rate between illuminations in response to a need to increase capacitor voltage.

9. A strobe as in claim 7 which includes constant frequency, variable duty cycle capacitor charging circuitry.

10. A strobe as in claim 9 wherein the instructions alter the duty cycle in response to applied input voltage.

11. A strobe comprising:

a housing;

a triggerable source of illumination carried by the housing;

control circuitry carried by the housing and coupled to the source of illumination;

an illumination output specifying element, coupled to the control circuitry, for specifying a desired light output;

a power supply, carried by the housing, and coupled to the control circuit, wherein the supply includes input terminals for receipt of electrical energy of varying levels; and wherein the control circuitry is responsive to received levels of electrical energy varying over at least 8–30 volts to provide the specified output of illumination, and wherein the control circuitry initiates each charging cycle by step-wise increasing a capacitor charging duty cycle parameter on a predetermined basis prior to altering that parameter in response to a feedback signal from the capacitor.

12. A strobe as in claim 11 which includes circuitry which senses synchronizing pulses received at the input terminals.

13. A strobe as in claim 12 which includes an audible output device and circuitry for driving the output device in response to sensed synchronization pulses.

14. A strobe as in claim 11 which includes a storage capacitor for accumulating electrical energy for triggering the source and wherein the control circuitry includes executable instructions for adjusting a rate of charging the capacitor in response to a received level of electrical energy.

15. A strobe as in claim 14 which includes instructions for increasing a charging duty cycle on a per cycle basis.

16. A strobe as in claim 14 which includes circuitry which senses synchronizing pulses received at the input terminals.

17. A strobe comprising:

a housing;

a light source;

a capacitor coupled to the source;

a candela specifying element;

input terminals for receipt of voltages in ranges of both 8–18 volts and 16–33 volts;

control circuitry, carried in the housing coupled at least to the capacitor, and the specifying element and instructions for charging the capacitor in a closed control loop in accordance with the specifying element and received voltage to drive the source to produce the specified candela; and wherein the processor executes pre-stored instructions for altering a charging rate of the capacitor in response to a selected candela output parameter.

18. A strobe as in claim 17 wherein the control circuitry stores parameters indicative of each specifiable candela.

19. A strobe as in claim 17 wherein the control circuitry includes a programmed processor and storage for output parameters associated with respective specifiable candela.

20. A strobe as in claim 17 wherein the control circuitry illuminates the source, at least at a first predetermined rate, and wherein the instructions alter the charging rate between illuminations.

21. A strobe as in claim 20 wherein the instructions repetitively increase the charging rate between illuminations in response to a need to increase capacitor voltage.

22. A strobe as in claim 20 which includes constant frequency, variable duty cycle capacitor charging circuitry.

23. A strobe as in claim 22 wherein the instructions alter the duty cycle in response to applied input voltage.

24. A strobe comprising:

a housing;

a light source;

a capacitor coupled to the source;

a candela specifying element;

input terminals for receipt of voltages in one of a range of 8–17 volts or 16–33 volts;

control circuitry, carried in the housing, coupled at least to the specifying element and a feedback circuit, the feedback circuit is also coupled to the capacitor wherein the control circuit alters a capacitor charging parameter in response to at least one feedback signal from the feedback circuit so as to produce the specified candela output at the light source; and wherein the at least one feedback signal comprises one of a digitized capacitor voltage value or a selected signal transition indicative of a capacitor voltage.

25. A strobe as in claim 24 which includes capacitor drive circuitry coupled between the control circuitry and the capacitor.

26. A strobe comprising:

a housing;

a light source;

a capacitor coupled to the source;

a candela specifying element;

input terminals for receipt of voltages in one of a range of 8–17 volts or 16–33 volts;

control circuitry, carried in the housing, coupled at least to the specifying element and a feedback circuit, the feedback circuit is also coupled to the capacitor wherein the control circuit alters a capacitor charging parameter in response to at least one feedback signal from the feedback circuit so as to produce the specified candela output at the light source;

capacitor drive circuitry coupled between the control circuitry and the capacitor; and wherein the drive circuitry alters a capacitor charging current duty cycle in response to the control circuitry.

27. A strobe comprising:

a housing;

a light source;

a capacitor coupled to the source;

a candela specifying element;

input terminals for receipt of voltages in one of a range of 8–17 volts or 16–33 volts;

control circuitry, carried in the housing, coupled at least to the specifying element and a feedback circuit, the feedback circuit is also coupled to the capacitor wherein the control circuit alters a capacitor charging parameter in response to at least one feedback signal from the feedback circuit so as to produce the specified candela output at the light source;

capacitor drive circuitry coupled between the control circuitry and the capacitor; and wherein the drive circuitry includes a constant frequency, variable duty cycle capacitor charging current generator coupled to the control circuitry and to the capacitor wherein the control circuitry varies the charging current duty cycle in response to both the feedback signal and the candela specifying element.

28. A strobe comprising:

a housing;

a light source;

a capacitor coupled to the source;

a candela specifying element;

input terminals for receipt of voltages in one of a range of 8–17 volts or 16–33 volts;

control circuitry, carried in the housing, coupled at least to the specifying element and a feedback circuit, the feedback circuit is also coupled to the capacitor wherein the control circuit alters a capacitor charging parameter in response to at least one feedback signal from the feedback circuit so as to produce the specified candela output at the light source; and wherein the duty cycle is adjusted periodically in response to the feedback signal.

29. A strobe comprising:

a housing;

a light source;

a capacitor coupled to the source;

a candela specifying element;

input terminals for receipt of voltages in one of a range of 8–17 volts or 16–33 volts;

control circuitry, carried in the housing, coupled at least to the specifying element and a feedback circuit, the feedback circuit is also coupled to the capacitor wherein the control circuit alters a capacitor charging parameter in response to at least one feedback signal from the feedback circuit so as to produce the specified candela output at the light source; and wherein the control circuitry alters the charging current parameter periodically.

30. A strobe comprising:

a housing;

a light source;

a capacitor coupled to the source;

a candela specifying element;

input terminals for receipt of voltages in a range of 8–17 volts and a range of 16–33 volts;

control circuitry, carried in the housing, coupled at least to the specifying element and a feedback circuit, the feedback circuit is also coupled to the capacitor wherein the control circuit repetitively charges the capacitor during a plurality of cycles and during each such cycle that circuitry alters a capacitor charging parameter in response to at least one feedback signal from the feedback circuit so as to produce the specified candela output at the light source.

* * * * *